United States Patent [19]

Place et al.

[11] 4,101,457

[45] Jul. 18, 1978

[54] ENZYME-CONTAINING AUTOMATIC DISHWASHING COMPOSITION

[75] Inventors: Geoffrey Place; Edward John Maguire, Jr., both of Cincinnati, Ohio

[73] Assignee: The Procter & Gamble Company, Cincinnati, Ohio

[21] Appl. No.: 699,415

[22] Filed: Jun. 24, 1976

Related U.S. Application Data

[63] Continuation-in-part of Ser. No. 635,830, Nov. 28, 1975, abandoned, which is a continuation-in-part of Ser. No. 479,952, Jun. 17, 1975, abandoned.

[51] Int. Cl.[2] ..... C11D 1/12

[52] U.S. Cl. ..... 252/559; 252/89 R; 252/321; 252/358; 252/529; 252/DIG. 1; 252/DIG. 12; 252/DIG. 15

[58] Field of Search ..... 252/589, DIG. 1, DIG. 12, 252/DIG. 15, 529, 321, 358, 89

[56] References Cited

U.S. PATENT DOCUMENTS

| | | | |
|---|---|---|---|
| 2,340,035 | 1/1944 | Zimmer et al. | 252/321 |
| 3,250,727 | 5/1966 | Woll et al. | 252/321 |
| 3,314,891 | 4/1967 | Schmolka et al. | 252/89 |
| 3,858,854 | 1/1975 | Win et al. | 252/89 |
| 4,001,132 | 1/1977 | Maguire, Jr. | 252/89 R |

*Primary Examiner*—Mayer Weinblatt
*Attorney, Agent, or Firm*—Edmund F. Gebhardt; Richard C. Witte; Thomas H. O'Flaherty

[57] ABSTRACT

Bleach-free, brightener-free automatic dishwashing compositions comprising a binary active system and an enzyme having an isoelectric point greater than about 8.5. The binary active system comprises a nonionic surfactant, preferably an ethoxylated nonionic, and a sulfonated aromatic compatibilizing agent. Preferred enzymes have an iso-electric point in the range from about 9.5 to about 12.0. Especially preferred enzymes are those exhibiting a proteolytic activity of 80 to 100% of maximum activity when measured at pH 12 by the Anson hemoglobin method carried out in the presence of urea. The inclusion of these particularly preferred enzymes permits the formulation of the detergent composition without the sulfonated aromatic compatibilizing agent. The instant compositions exhibit enhanced anti-redeposition properties for soils composed of grease and grease-protein complexes thereby insuring the virtual elimination of streaks and spots on the hard surfaces being cleaned. A process for cleaning dishes utilizing the compositions of the present invention is also disclosed.

9 Claims, No Drawings

ENZYME-CONTAINING AUTOMATIC DISHWASHING COMPOSITION

CROSS REFERENCE TO RELATED APPLICATION

This application is a continuation-in-part of copending application U.S. patent application Ser. No. 635,830; filed Nov. 28, 1975 now abandoned; entitled ENZYME-CONTAINING AUTOMATIC DISHWASHING DETERGENT COMPOSITION; inventors: Geoffrey Place and Edward J. Maguire, Jr., which was a continuation-in-part of U.S. patent application Ser. No. 479,952, filed June 17, 1975, now abandoned.

BACKGROUND OF THE INVENTION

This invention relates to detergent cleaning compositions which are particularly suitable for use in automatic dishwashers. In detail, the compositions herein comprise a binary active system and a particular enzyme, the compositions being substantially free of bleach components and brighteners. The binary active system comprises a nonionic surfactant, preferably an ethoxylated nonionic, and a compatibilizing agent which is represented by a sulfonated aromatic hydrotrope. The enzymes adapted for use herein have an iso-electric point greater than about 8.5. The constituents of the binary active system are present in major amounts, preferably in about equiponderal quantities. The compositions of this invention are capable of providing, during conventional use, markedly enhanced overall cleaning performance for a broad range of soils, and anti-redeposition benefits, particularly for soils composed of grease and grease-protein complexes. The instant compositions, in addition to the essential components, preferably comprise conventional dishwashing composition additives in the art-established levels for their known functions. Examples of such additives include sodium silicate solids, sodium carbonate, sodium bicarbonate, sodium sulfate and sodium phosphate. It is noteworthy that the compositions herein are capable of providing outstanding dishwashing performance in the total absence of phosphorus-containing detergent builders, or in the presence of a reduced level thereof as well as in fully polyphospnate built compositions.

Particularly preferred enzymes are proteolytic enzymes which exhibit a proteolytic activity of 80 to 100% of maximum activity when measured at pH 12 using the Anson hemoglobin method carried out in the presence of urea. When these particular enzymes are included the detergent compositions may be formulated without the sulfonated aromatic compatibilizing agent, while still retaining enhanced anti-redeposition properties.

Conventional automatic dishwashing compositions usually contain a low-foaming surface-active agent, a chlorine bleach, alkaline builder materials, and usual minor ingredients and additives. The incorporation of chlorine bleaches requires special processing and storage precautions to protect components which are subject to deterioration upon direct contact with active chlorine. The stability of the chlorine bleach is also critical and raises additional processing and storage difficulties. It is also known that detergent compositions for use in automatic dishwashers can tarnish silverware and damage metal trim on china as a result of the presence of chlorine-containing bleaches therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly difficult in light of the fact that during automatic dishwashing operations, active chlorine prevents the formation and/or deposition of troublesome proteins and proteingrease complexes on the hard surfaces and no surfactant system is currently known capable of performing that function.

The disclosures of all Patents mentioned hereinafter are incorporated by reference.

The disclosures of U.S. pat. No. 3,549,539 to Mallows relate to machine dishwashing powders containing a nonylphenol-5-EO or a condensation product of a random $C_{11}$ to $C_{15}$ secondary alcohol and ethylene oxide with an HLB (hydrophilic-lipophilic balance) value between 11.5 and 13.5 and a polyethylene oxidepolypropylene oxide condensate that consists of between 5 and 25% polyethylene oxide and 95 to 75% polypropylene oxide and has a molecular weight between 1500 and 2700. It is disclosed that in addition to the above surfactant combination the machine dishwashing powder will normally contain from 5 to 30% of a silicate such as sodium metasilicate, from 5 to 30% of an oxidizing agent, from 25 to 70% of a calcium ion sequestrant and from 1 to 20% of an inorganic filler salt, such as sodium carbonate or sodium sulfate. The oxidizing agents can be represented by chlorinated sodium orthophosphate, chlorinated isocyanurate and perborate possibly with a copper catalyst or an organic activator. Additional disclosures relative to bleachcontaining detergent compositions for use in automatic dishwashers can be found in, for example, U.S. Pat. Nos. 3,410,804; 3,390,092; 3,248,330 and 3,595,968.

In addition, the presence of bleaching components in the detergent composition can have a detrimental effect on the activity of enzymes contained in the composition.

Various attempts have also been made to formulate bleach-free low-foaming detergent compositions for automatic dishwashing machines containing particular lowfoaming nonionics, builders and filler materials and additives adapted to provide a particular function. As an example, U.S. Pat. No. 3,022,250 to Grifo relates to low sudsing detergent compositions especially adapted for automatic dishwashing machines containing a phenol having therein an aliphatic substituent with an average of 9 carbons atoms per chain and a second substituent comprising condensed ethylene oxide in an average number of 4 molecules per molecule of phenol, together with builders consisting essentially of a mixture of sodium metasilicate and sodium tripolyphosphate in the proportion of 1 part of metasilicate to 3 parts of tripolyphosphate, the builders being present in the proportion of 95 parts of builder mixture to 5 parts of alkyl phenol ethylene oxide. The disclosures of U.S Pat. No. 3,048,548 to Martin et al. relate to substantially identical subject matter wherein the nonionic low-foaming surface-active agent can be represented by specific polyoxyalkylene glycol mixtures. U.S. Pat. No. 3,382,178 to Lissant et al. also pertains to automatic dishwashing compositions comprising a de-foaming nonionic surfactant having a specific formula and a small amount of an anti-oxidant for the purpose of reducing, inhibiting and/or preventing alkali degradation of the nonionic surfactant thereby rendering it stable in alkaline detergents, particularly during prolonged storage.

U.S. Pat. No. 3,576,122 to Payne et al relates to stable aqueous emulsions which are intended for use as laundering detergents and which contain nonionic surfactant and, as part of an emulsion stabilizer system, a hydrotropic material. Belgian Pat. No. 824,591 discloses an abrasive composition containing a silicaceous abrasive, an anionic detergent, especially alkyl benzene sulfonate, and a hydrotropic material such as sodium cumene sulfonate.

French Pat. No. 2,102,851 to Colgate-Palmolive, pertains to rinsing and washing compositions for use in automatic dishwashers. The compositions disclosed have a pH from about 6–7 and contain an amylolytic and, if desired, a proteolytic enzyme, which have been prepared in a special manner from animal pancreas and which exhibit a desirable activity at a pH in the range from about 6–7. German Patent Offenlegnngsschrift No. 2,038,103 relates to aqueous liquid or pasty cleaning compositions containing phosphate salts, enzymes and an enzyme-stabilizing compound. British Patent Specification No. 1,361,386 and U.S. Pat. No. 3,827,938 to Novo Therapeutisk Laboratories A/S, disclose proteolytic enzymes which exhibit high activity in alkaline systems, and exemplify their use in bleach-containing laundry detergent compositions.

Copending U.S. patent application Ser. No. 635,831; entitled: AUTOMATIC DISHWASHING DETERGENT COMPOSITION; Inventors: Edward J. Maguire, Jr., and Robert A. Staab; relates to bleach-free detergent compositions for use in automatic dishwashers comprising an alkoxylated nonionic surface-active agent and a sulfonated aromatic compatibilizing agent such as, for example, xylene-, toluene, cumene- and benzenesulfonate. U.S. patent application Ser. No. 4,79,969, now U.S. Pat. No. 4,001,132; entitled: AUTOMATIC DISHWASHING DETERGENT COMPOSITIONS; Inventor: Edward J. Maguire, Jr.; pertains to bleach-free detergent compositions for use in automatic dishwashers comprising an alkoxylated nonionic surface-active agent, a sulfonated aromatic compatibilizing agent such as, for example, xylene-, toluene-, cumene- and benzenesulfonate and a mixture of a water-soluble sulfate and a water-soluble sulfite. Concurrently filed U.S. patent application Ser. No. 699,416 entitled ENZYME CONTAINING AUTOMATIC DISHWASHING DETERGENT COMPOSITION, Maguire and Pancheri, relates to detergent compositions for use in automatic dishwashers, containing a nonionic surface active agent and a enzyme mixture containing a specifically selected proteolytic enzyme and an amylolytic enzyme.

While the prior art clearly recognizes the disadvantages of using aggressive bleaches in automatic dishwashing operations and also suggests bleach-free compositions by merely leaving out the bleach component, said art disclosures are silent about how to formulate bleach-free automatic dishwashing compositions capable of providing superior performance during conventional use.

It is an object of this invention to formulate bleach-free detergent compositions capable of providing superior anti-redeposition characteristics in automatic dishwashing operations.

It is an additional object of this invention to effectively incorporate enzymes in detergent compositions for use in automatic dishwashing operations with a view to optimize cleaning performance for a broad range of soils.

It is a further object of this invention to provide a detergent composition for use in automatic dishwashers capable of providing at least equal or better performance, with a lower level of active ingredients, than automatic dishwashing compositions commercially available now.

It is further an object of the invention to provide enzyme-containing compositions in a product form which reduces the tendency of the enzyme to become deactivated during the use of the product.

The above and other objects are now achieved by formulating bleach-free detergent compositions comprising a binary active system and specific enzymes.

SUMMARY OF THE INVENTION

This invention is in part based on the discovery that highly effective automatic dishwashing detergent compositions can now be formulated which are substantially free of bleach components. In more detail, the compositions of this invention comprise:

(a) at least about 0.5% by weight of a nonionic surface-active agent;

(b) at least about 2% by weight of a sulfonated aromatic compatibilizing agent having a critical micelle concentration greater than about 1% by weight-/volume at 25° C, wherein the weight ratio of (a) to (b) is in the range from about 2:5 to about 5:3;

(c) from 0.001% to about 5% by weight of an enzyme having an iso-electric point greater than 8.5; and (d) which are substantially free of bleach components and brighteners.

It is advantageous to be able to formulate the detergent compositions of the present invention without brighteners in order to reduce the formulation costs of the compositions.

In a preferred embodiment, the nonionic surface-active agent is alkoxylated with a moiety selected from the group consisting of ethylene oxide, propylene oxide and mixtures thereof.

In a preferred embodiment, an ethoxylated nonionic ingredient is used in combination with a compatibilizing agent selected from the group consisting of toluene, xylene, cumene, benzene, ethylbenzene, ethylmethylbenzene and trimethylbenzene sulfonate. The preferred weight ratio of alkoxylated nonionic to compatibilizing agent is in the range from about 3:5 to about 5:4, especially about 1:1. The preferred enzymes have an iso-electric point in the range from about 9.5 to about 12.0.

Particularly preferred enzymes are those proteolytic enzymes exhibiting a proteolytic activity of 80 to 100% of maximum activity when measured at pH 12 using the Anson hemoglobin method in the presence of urea. When these particular preferred enzymes are used, the detergent compositions may be formulated without the aromatic sulfonated compatibilizing agent, while still retaining their antiredeposition benefits.

In one embodiment of the invention, the composition is in the form of a solid, preferably granular, composition and comprises up to about 20% by weight of the nonionic surface-active agent and up to about 20% by weight of the aromatic compatibilizing agent. The binary active system in this embodiment thus represents from about 6 to about 40%, more perferably from about 10 to 30% of the solid detergent composition.

In a second and preferred embodiment of the invention, the composition is in the form of a viscous liquid, slurry, foam, paste or gel and comprises from about 20 to about 90%, more preferably from 30 to 80%, of the binary active system. It is generally important that automatic dishwashing machine products are retained in some form of dispenser prior to use. The dispenser provided in most machines is not fluid-tight and the product form of this second embodiment should be such that the viscous liquid or paste does not leak from the dispenser.

It has been found that when enzymes are incorporated into granular products, there is a tendency towards deactivation of the enzyme component because of leakage of water into the dispenser cup during a pre-wash cycle of a dishwashing machine. The water at least partially dissolves the product and creates a highly alkaline environment, whereby the enzyme tends to lose its activity before entering the machine itself.

Viscous liquid or paste-like products are less prone to this deactivation because of the very much smaller surface area available to the leaked water. The enzyme is thus, to a large extent, protected in the bulk of the composition.

Generally, if the product is in liquid form, the liquid should be thixotropic (i.e., exhibit high viscosity when subjected to low stress and lower viscosity when subjected to high stress) or at least have a very high viscosity, e.g., in the range of 1000–10,000,000 centipoise. Pasty compositions of the invention generally have viscosities above about 5000 centipoise and up to several hundred million centipoise.

A process for cleaning dishes utilizing the compositions of the present invention is also disclosed.

DETAILED DESCRIPTION OF THE INVENTION

The automatic dishwashing detergent compositions of this invention comprise (1) a binary active system; (2) an enzyme having a specific iso-electric point; and (3) are free of bleach and brightener components; these essential parameters are discussed in detail hereinafter.

Unless stated to the contrary, the "percent" indications stand for percent by weight.

The active component for use herein is represented by a mixture of a nonionic surface-active agent and a sulfonated aromatic compatibilizing agent having a critical micelle concentration greater than about 1% (weight/ volume) at 25° C. The binary active mixture is used in an amount from about 2.5 to about 40%, preferably from about 10 to about 20%, in granular compositions, and from about 20 to about 90%, preferably from about 30 to about 80%, in pasty or gelled compositions. Liquid compositions of low viscosity (e.g. under 1000 centipoise) are also possible but are not preferred because of the difficulty of dispensing such fluid materials in conventional dishwashing machines. The weight ratio of nonionic surfactant to compatibilizing agent is, generally, in the range from about 2:5 to about 5:3, preferably from about 3:5 to about 5:4, especially about 1:1. The mixture of nonionic surfactant and compatibilizing agent represents more than about 2.5% to provide superior anti-redeposition and drinage performance, thereby virtually eliminating all residual spots and streaks on the hard surfaces being cleaned. Using less than about 2.5% of the surfactant mixture may create surface drainage problems and could adversely affect the use of the subject compositions for the intended purpose. However, when particularly referred proteolytic enzymes, disclosed herein, are included in the composition, the amount of compatibilizing agent may be reduced or eliminated completely. The inclusion of these preferred enzymes results in detergent compositions which exhibit the superior anti-redeposition effects, while utilizing active levels which may be lower than 2.5% of the total composition.

The binary active system desirably is kept below about 20% in the case of a granular detergent composition. Using more than about 20% in the case of a granular detergent composition can contribute to a lumping and caking tendency of the product.

In the case of a paste-like, gelled or viscous liquid product, very much higher active levels can be tolerated. Thus, by choosing an appropriate nonionic surfactant and compatibilizing agent, it is possible to formulate a product in paste form which contains up to about 90% of the binary active system. Normally, small quantities of materials such as solubilizers, thickeners, and the like, will be included to provide stable easily-dispensed compositions.

As noted above, the performance advantages of the compositions herein can only be achieved for a narrow and specific weight ratio of nonionic surfactant to compatibilizing agent. The weight ratio of the nonionic ingredient to the compatibilizing agent clearly reveals that the latter is used as a major composition constituent. In fact, in a highly preferred embodiment about equiponderant quantities of the nonionic ingredient and the compatibilizer are used. Variations in the weight ratios of the surfactant and the compatibilizing agent outside of the ranges specified are detractive to the attainment of the superior performance supplied by the instant compositions. However, when the enzyme incorporated in the composition is a proteolytic enzyme which exhibits a proteolytic activity of from about 80 to 100% of its maximum activity when measured at pH 12 using the Anson hemoglobin method in the presence of urea, the level of compatibilizing agent in the composition may be lowered or eliminated completely, while still retaining the anti-redeposition benefits of the composition.

The surface active component for use herein comprises at least about 0.5% of a nonionic surface active agent. The surfactant level desirably is kept below about 20%, and preferably from about 1 to about 10%, in the case of a granular detergent composition. In the case of a paste-like, gelled or viscous liquid product, the composition may comprise up to about 55% of the nonionic surface active agent. Preferred paste or gelled compositions contain from about 2.5 to about 25% of the nonionic surface active agent.

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. A typical listing of the classes and species of such nonionic surfactants useful herein appears in U.S. Pat. No. 3,664,961, incorporated herein by reference.

Preferred nonionic surface active agents are those in which the alkoxy moiety is selected from the group consisting of ethylene oxide, propylene oxide and mixtures thereof. Ethylene oxide represents the preferred condensation partner. The alkylene oxide moiety is condensed with a nonionic base material according to techniques known in the art. All alkoxylated nonionic detergents which are normally known to be suitable for use in detergent technology can be used herein. Examples of the like components include:

(1) The condensation product of one mole of a saturated or unsaturated, straight or branched chain carboxylic acid having from about 10 to about 18 carbon atoms with from about 5 to about 50 moles of ethylene oxide. The acid moiety can consist of mixtures of acids in the above delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$ and 9% $C_{16}$ with 35 moles of ethylene oxide is a specific example of a nonionic containing a mixture of different chain lengths fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 5 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$ and 9% $C_{16}$ with 45 moles of ethylene oxide ($CNAE_{45}$) is a specific example of a nonionic containing a mixture of different chain length alcohol moieties. Other specific examples of nonionics of this type are the condensation products of one mole of tallow alcohol with 9 and 20 moles of ethylene oxide respectively; the condensation products of one mole of lauryl alcohol with 35 moles of ethylene oxide; the condensation products of one mole of myristyl alcohol with 30 moles of ethylene oxide; the condensation product of one mole of secondary alcohol containing 14 to 15 carbon atoms with seven moles of ethylene oxide; the condensation product of one mole of primary alcohol containing 12 to 13 carbon atoms with four moles of ethylene oxide, the mono- and non-ethoxylated moieties being removed by stripping; and the condensation products of one mole of oleyl alcohol with 40 moles of ethylene oxide.

(3) Polyethylene glycols having a molecular weight of from about 1400 to about 30,000. For example, Dow Chemical Company manufactures these nonionics in molecular weights of 20,000, 9500, 7500, 4500, 3400 and 1450. All of these nonionics are waxlike solids which melt between 110° and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; and the condensation products of one mole of hexadecyl phenol with 30 moles of ethylene (5) The ethoxylated surfactants disclosed in U.S. patent application Ser. No. 453,464, filed Mar. 21, 1974, inventor Jerome H. Collins still pending, incorporated herein by reference, consisting essentially of a mixture of compounds having at least two levels of ethylene oxide addition and having the formula:

$$R_1 - R_2 - O(CH_2CH_2O)_nH$$

wherein $R_1$ is a linear alkyl residue and $R_2$ has the formulaa $$-CHR_3CH_2-$$

wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within ± 1 carbon atom of the mean, wherein $3.5<n<6.5$, provided that the total amount of components in which $n = 0$ is not greater than 5% by weight and the total amount of components in which $n = 2$–7 inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Low-foaming alkoxylated nonionics are preferred although other (than low-foaming) alkoxylated nonionics can be used without departing from the spirit of this invention. Examples of nonionic low-foaming surface-active components include the condensation products of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; polyetheresters of the formula $$(ClC_6H_4)_2\,CHCO_2(CH_2.CH_2.O)_xR$$

wherein $x$ is an integer from 4 to 20 and R is a lower alkyl group containing not more than 4 carbon atoms, for example a component having the formula $$(CLC_6H_4)_2CHCO_2(CH_2CH_2O)_{15}.CH_3;$$

the polyalkoxylation products of alkyl phenol, for example, the polyglycol alkyl phenol ethers containing an alkyl group having at least 6 and, normally, from about 8 to about 20 carbon atoms and having a molar ratio of ethylene oxide to condensate of about 7.5; 9.0; 11.5; 20.5 and 30. The alkyl group can, for example, be represented by di-isobutylene; di-amyl; polymerized propylene; iso-octyl; and nonyl.

Additional examples of effective low-foaming nonionics include: the polyalkyklene glycol condensates of U.S. Pat. No. 3,048,548, hereby incorporated by reference, having alternating hydrophilic oxyethylene chains and hydrophobic oxypropylene chains wherein the weight of the terminal hydrophobic chains, the weight of the middle hydrophobic unit and the weight of the linking hydrophilic units each represent about 1/3 of the condensate; the de-foaming nonionic surfactants disclosed in U.S. Pat. No. 3,382,178, incorporated herein by reference, having the general formula $$Z[(OR)_nOH]_z$$

wherein Z is alkoxylatable material, R is a radical derived from an alkylene oxide which can be ethylene and propylene and n is an integer from, for example, 10 to 2000 or more and z is an integer determined by the number of reactive oxyalkylatable groups. Z can be represented by normal biodegradable alcohols such as, for example, obtained by reduction of fatty acids derived from coconut oil, palm kernel oil, tallow and also those obtained from petroleum such as, for example, the mixtures of $C_{10}$ to $C_{18}$ straight-chain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide having an HLB value between 11.5 and 13.5; and a polyethylene oxide/polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$$Y(C_3H_6O)_n(C_2H_4O)_mH$$

wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10 to 90 weight percent of the molecule; the conjugated polyoxyalkylene compounds described in U.S. Pat. No. 2,674,619, incorporated herein by reference, having the formula:

$$Y[(CL_3H_6O)_n(C_2H_4O)_mH]_x$$

wherein Y is the residue of an organic compound having from about 2 to 6 carbon atoms and containing $x$ reactive hydrogen atoms in which $x$ has a value of at least about 2, $n$ has a value such that the molecular weight of the polyoxypropylene hydrophobic base is at least about 900 and m has a value such that the oxyethylene content of the molecule is from about 10 to 90 weight percent. Compounds falling within the scope of the definition for Y include, for example, propylene glycol, glycerine, pentaerythritol, trimethylolpropane, ethylene diamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$$P[(C_3H_6O)_n(C_2H_4O)_mH]_x$$

wherein P is the residue of an organic compound having from about 8 to 18 carbon atoms and containing x reactive hydrogen atoms in which $x$ has a value of 1 or 2, $n$ has a value such that the molecular weight of the polyoxypropylene portion is at least about 58 and m has a value such that the oxyethylene content of the molecule is from about 10 to 90 weight percent and the formula:

$$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, n has a value such that the molecular weight of the polyoxyethylene portion is at least about 44 and m has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Preferred nonionic surfactants for use in the present invention include the mono- and polyalkoxy substituted surfactants having the terminal hydroxyl of the alkoxy group acylated by certain monobasic acids ("capped" surfactants), described in U.S. patent application Ser. No. 621,456, Williams, filed Oct. 10, 1975, still pending, incorporated herein by reference.

Highly preferred alkoxylated nonionics for use herein include the condensation product of one mole of tallow alcohol with from about 6 to about 20 moles, especially 9 moles of ethylene oxide; the alkoxylate commercially available under the tradename PLURADOT HA-433 ®Wyandotte Chemical Corp., which has a molecular weight in the range from 3700–4200 and contains about 3% monostearyl acid phosphate suds suppressant; and also the condensation product of $C_{14-15}$ alcohol with from 5 to 17 moles, particularly 7–9 moles, of ethylene oxide. An example of such a surfactant is the condensation product with 7 moles of ethylene oxide, commercially available as NEODOL 45–7 from Shell Chemical Corp.

Another component for use in the compositions of this invention is a sulfonated aromatic compatibilizing agent having a critical micelle concentration greater than about 1%, preferably greater than about 2% at 25° C. The compatibilizing agent may be used in an amount of up to about 55%, preferably from about 2 to about 55%. As already pointed out hereinbefore, the compatibilizing agent and the nonionic surface-active agents are used in specific weight ratios to obtain the performance advantages of the subject compositions.

The critical micelle concentration (CMC) is determined by plotting the surface tension of a solution of a particular compatibilizing agent versus the logarithm of its concentration, all measurements being made at room temperature (25° C). The surface tension is measured according to the method set forth in *JOURNAL OF THE AMERICAN CHEMICAL SOCIETY,* 52, 1751, (1930) by Harkins, W. D. and Jordan, H. E. Various other techniques can also be used for measuring the surface tension of compatibilizing agents; for example, light scattering measurements as described in *NONIONIC SURFACTANTS,* Chapter 16, Thermodynamics of Micelle Formation, by Hall, D. G. and Pethica, B. A., pages 543–47, Marcel Dekker, New York, 1967.

The critical micelle concentration of the compatibilizing agents herein, being greater than 1%, preferably greater than 2% (weight/volume), denotes that during conventional automatic dishwashing operations the detergent concentration being frequently in the range from about 0.1–0.6%, this component does not act as a surface-active agent in the art-established meaning for that term. It is also noteworthy that the preferred compatibilizing agents are known in detergent technology for their hydrotropic properties. In that prior art context, hydrotropes can be functionally defined as being (organic) compounds having hydrophile-hydrophobe properties, and capable in high concentration of increasing the solubility of other organic compounds in water or in aqueous salt solutions. Accordingly, hydrotropes are used in liquid detergent compositions to aid and augment the solubility of, for example, relatively high levels of surface-active agents and inorganic detergent builders. The detergent compositions of this invention being either solid or preferably, pasty or gel-like and easily soluble, (the term soluble is meant to embrace dispersible) at the conventional automatic dishwashing usage concentration (0.1–9.6%), it is obvious that the known hydrotrope functionality does not give any clue as to how the compatibilizing agent functions in compositions of the present invention, as is clear from the fact that the agent is equally effective both in solid (granular) and in pasty compositions.

Apparently, however, and without being limited as a result thereof, the compatibilizing agent aids in the wetting and hydrolysis of soil on the hard surfaces cleaned, and in solution it facilitates soil dispersion and suspension. The compatibilizing agent can also provide interaction with dissolved (dispersed) proteins to hold them in solution via surface-active analogous properties and/or formation of mixed miscelles.

The critical micelle concentration (CMC) of sodium cumene sulfonate is >2% at 25° C while the nonionic ethylene oxide-propylene oxide condensate commercially known as Pluradot HA-433 has under identical conditions a CMC of 0.002%. A mixture of sodium cumene sulfonate and Pluradot HA-433 in equal amounts behaves very much the same as the nonionic by itself, thus indicating that the compatibilizing agent has only a small, if any, effect on the surface-active properties of the nonionic.

As already defined hereinbefore, the compatibilizing agent contains an aromatic and a sulfonate group. The aromatic radical can, for example, be a benzene, a naphthalene or a biphenyl radical, assuming its sulfonated derivative meets the CMC requirement set forth herein. Commercially available examples of sulfonatable compatibilizing agent precursors which can be used in the compositions of this invention include benzene, toluene, xylene, cumene, trimethylbenzene, ethylbenzene and ethylmethylbenzene. Commercial xylene is frequently a mixture of ortho, meta and para species. Similarly, trimethylbenzene can be represented by 1,2,3-trimethylbenzene or hemimellitene; 1,3,5-trimethylbenzene or mesitylene; and 1,2,4-trimethylbenzene or pseudocumene. The above enumeration is not intended to be limiting but a mere exemplification of suitable precursors. Of course, other sulfonatable precursors can qualify for use in the compositions of the instant invention, provided these compounds, in sulfonated form, meet with the definition herein, especially the minimum critical miscelle concentration. The above organic precursors can be sulfonated according to methods known in the art.

Preferred compatibilizing agents include the alkali metal salts of cumene sulfonate, ethylbenzene sulfonate, toluene sulfonate, benzene sulfonate, xylene sulfonate, ethylmethylbenzene sulfonate, trimethylbenzene sulfonate and mixtures thereof.

The enzyme component herein is incorporated into the detergent compositions in an effective amount, such that the detergent composition has a proteolytic activity of at least 6.0 Anson units/kg. Using commercial enzyme preparations generally available, this corresponds to about from 0.001 to about 5%, preferably from about 0.1 to about 1.5% of the detergent composition comprising the enzyme component. The enzyme component is additionally characterized by an iso-electric point greater than about 8.5, preferably from about 9.5 to about 12.0. The term "greater than" represents an absolute measure, i.e. greater than 9.0 is, for example, 9.2, 9.5, etc. An iso-electric point of, for example, about 7.5 is, as used herein, to be considered as being smaller than 9.0.

Enzymes are important and essential components of biological systems, their function being to catalyze and facilitate organic (and inorganic) reactions. For example, enzymes are essential to metabolic reactions occurring in animal and plant life.

All enzymes are proteins which, in general, are made of many amino acids of the L-configuration linked by an amide bond between the carboxyl group of one amino acid and the $\alpha$-amino of another (peptide bond). It is also known that some proteolytic enzymes have crucial dependencies on non-protein prosthetic groups or cofactors. A polypeptide is normally considered to be a protein when it contains minimally from about 40 to 75 peptide bonds. A cofactor can be termed as any substance required for the manifestation of enzymic activity and which emerges unchanged from the reaction. These cofactors apparently are not involved, however, in the catalytic events of enzyme function. Rather, their role seems to be one of maintaining the enzyme in an active configuration. Enzymes are considered to exhibit their catalytic activity by virtue of three general characteristics: the formation of noncovalent complex with the substrate; substrate specificity; and catalytic activity. Many compounds may bind to an enzyme, but only certain types will lead to subsequent reaction; the latter are called substrates and they satisfy the particular enzyme's specificity requirement. Materials that bind but do not thereupon chemically react can affect the enzymic reaction either in a positive or negative way. For example, unreactive species, called inhibitors, can alter the enzymatic activity.

In detergent technology, enzymes aid and augment the removal of soils from objects to be cleaned. The enzymatic action may result from a series of individual chemical reactions inclusive of hydrolysis, oxidation, and substitution. As pointed out above, specific enzymes having a specific function either with respect to a particular chemical reaction or a particular kind of soil. Mixtures of enzymes having different functions can thus be used to optimize efficiency.

The enzymes adapted for use in the instant composition have, as already pointed out hereinbefore, an isoelectric point which is greater than 8.5, preferably from about 9.5 to about 12.0. The isoelectric point can be determined by any convenient technique known in the art. For example it can be measured by electrophoresis on agarose, according to the technique describbed by R. J. Wieme in *Agar Gel Electrophoresis*, Elsevier Publ. Comp. 1965. The iso-electric point is a characteristic property of enzymes. Enzymes comprise active moieties selected from, for example, carboxyl, hydoxyl, sulphydryl, amino, imidazole and mixtures thereof. If sufficiently acid conditions prevail, the, for example, carboxyl, hydroxyl and sulphydryl moieties are in their neutral form while the, for example, amino and imidazole moieties are in their protonated (positively charged) forms; the enzyme molecule therefore, has a net positive charge and migrates towards the cathode if a potential is applied. Conversely, at low acidity there will be an overall negative charge, and the molecule will migrate towards the anode. At some intermediate pH value the number of positive groups will be equal to the number of negative ones. The enzyme molecule will then have no net charge and there will be no movement in an electric field; the pH at which there is no migration is known as the isoelectric point. For optimum performance, the particular enzymes suitable for use in a particular composition have an iso-electric point which is at least equal and preferably about 0.5 greater than the pH of a 0.3% aqueous solution of the detergent composition. In other words, if the 0.3% aqueous detergent composition has a pH of 9.3, then the enzyme preferably has an iso-electric point of 9.8 or greater. Examples of enzymes suitable include many species which are known to be adapted for use in detergent compositions and, in fact, have been used as such. The like enzymes are frequently termed proteolytic and amylolytic enzymes. The commercial enzyme preparations ALCALASE, sold by NOVO INDUSTRIES, COPENHAGEN, and MAXATASE, sold by GIST-BROCADES, NV, DELFT, THE NETHERLANDS, can be used in the compositions of this invention. ALCALASE has an isoelectric point of about 9.1 as determined by OTTESEN and SPECTOR, COMPTES-RENDUS TRAV. LAB. CARLSBERG, vol. 32, 1960, no: 5, pp. 63.

Examples of preferred enzyme compositions include those commercially available under the tradename SP-72 (ESPERASE), manufactured and sold by NOVO INDUSTRIES A/S., COPENHAGEN, DENMARK; and AZ-PROTEASE, manufactured and sold by GIST-BROCADES N.V., DELFT, THE NETHERLANDS.

Particularly preferred enzymes adapted for use in The instant compositions are those proteolytic enzymes which exhibit a proteolytic activity of 80 to 100% of maximum activity when tested at pH 12 using the Anson hemoglobin method carried out in the presence of urea. The fact that these enzymes retain their activity in high pH systems, allows them to function effectively in the alkaline environment of an automatic dishwasher detergent composition. The Anson hemoglobin method is a procedure, well-known in the art, for determining the activity of proteolytic enzymes, and is fully described in the *Journal of General Physiology,* volume 22, pages 79–89 (1939). Such preferred enzymes may be obtained by the aerobic cultivation of specific protease-forming species of the genus Bacillus on a nutrient medium having a pH within the range of 9 to 11, while maintaining a pH in the nutrient medium between 7.5 and 10.5 during the main period of this cultivation. The preparation of these enzymes is described more fully in British Patent Specification No. 1,234,784, to Novo Terapeutisk Laboratorium A/S.

Examples of such preferred proteolytic enzymes are those described in the specification of Belgian Patent No. 721,730, page 31, table IX, type of enzymes 1. Preferred enzymes are those derived from strain numbers C372, C303, C367 and C370; these references corresponding to bacterium strains which have been deposited at The National Collection of Industrial Bacteria (NCIB), Torry Research Station, Aberdeen, Scotland. All relevant NCIB numbers are given in the specification of Belgian Pat. No. 721,730. Listed hereafter, by way of example, are the NCIB numbers for the bacterium strain producing some preferred enzyme species suitable for use in the composition of this invention: C372 corresponds to NCIB 10 317; C303 corresponds to NCIB 10 147; C367 to NCIB 10 313; and C370 to NCIB 10 315. The full series of NCIB numbers can be found on pages 4, 5 and 6 of the specification of the Belgian patent referred to herebefore.

Another preferred enzyme for use in the present invention is that described in U.S. Pat. No. 3,827,938, Anstrup et al, derived from Bacillus firmus strain NRS 783, which is on deposit with the U.S. Department of Agriculture, Agricultural Research Service, Northern Utilization Research and Development Division, 1815 N. University Street, Peoria, Ill. 61604, as strain NRRL No. B 1107. Preferred enzymes are marketed commercially by Novo Industries, Copenhagen, Denmark, under the tradenames SP-72 (ESPERASE) and SP-88.

When these preferred proteolytic enzymes are incorporated into the compositions of the present invention, the amount of compatibilizing agent in the compositions may be reduced or completely eliminated, while still retaining the composition's anti-redeposition benefits.

These particularly preferred enzymes may be incorporated into detergent compositions having a pH in use of from about 8.5 to about 11.5, particularly about 9 to 11, most particularly about 9.5 to about 10.5.

Both SP-72 and SP-88 may be advantageously incorporated into the detergent compositions of the present invention yielding the benefits described herein. Research has indicated that enzymes which have lower nitrogen contents reduce the possibility that the enzyme will cause any sensitization problems in those who come into contact with it. Because SP-88 has a low nitrogen content, it potentially decreases sensitization concerns which might occur through the use of the enzyme.

In addition to the essential enzyme component, other enzyme species, such as amylases and lipases, may be added in the usual amounts for detergent compositions.

The compositions of this invention frequently comprise a suds suppressing agent for the purpose of inhibiting the formation of excessive amounts of foam which can impair the mechanical operation of the dishwashing machine due to a lowering of the pressure at which the washing liquor is impelled against the hard surfaces. Of course, the final selection of the suds suppressing agent depends upon and can be required, in part, because of the qualitative and quantitative characteristics of the particular nonionic surface-active agent which is utilized in the automatic dishwashing compositions herein. In addition, food residues, especially proteinaceous food residues, exhibit suds boosting properties and therefore preferably require the presence of an effective suds regulating agent.

Suds regulating components are normally used in an amount from about 0.001 to about 5%, preferably from about 0.05 to about 3% and especially from about 0.10 to about 1%. The suds suppressing (regulating) agents known to be suitable in detergent context can be used in the compositions herein.

Preferred suds suppressing additives are described in U.S. Pat. No. 3,933,672, issued Jan. 20, 1976, Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as siloxane having the formula:

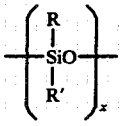

wherein x is from about 20 to about 2,000, and R and R' are each alkyl or aryl groups, especially methyl, ethyl, propyl, butyl and phenyl. THe polydimethylsiloxanes (R and R' are methyl) having a molecular weight within the range of from about 200 to about 200,000, and higher, are all useful as suds controlling agents. Additional suitable silicone materials wherein the side chain groups R and R' are alkyl, aryl, or mixed alkyl and aryl hydrocarbyl groups exhibit useful suds controlling properties. Examples of the like ingredients include diethyl-, dipropyl-, dibutyl-, methylethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. patent application Ser. No. 622,303, Gault et al, filed Oct. 14, 1975, now abandoned, incorporated herein by reference. An example of such a compound is DB-544, commercially available from Dow Corning, which is a siloxane/glycol copolymer.

Microcrystalline waxes having a melting point in the range from 35°–115° C and saponification value less than 100 represent an additional example of a preferred suds regulating component for use in the subject compositions. The microcrystalline waxes are substantially water-insoluble, but are water-dispersible in the presence of organic surfactants. Preferred microcrystalline waxes have a melting point from about 65° to 100° C, a molecular weight in the range from 400–1,000; and a penetration value of at least 6, measured at 77° F by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di-and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole percent of dialkyl phosphate and up to about 5 mole percent of trialkyl phosphate.

In addition to the components described hereinbefore, the compositions according to this invention can contain additional detergent composition ingredients which are known to be suitable for use in automatic dishwashing compositions in the art-established levels for their known functions. Organic and inorganic detergent builder ingredients, alkali materials, sequestering agents, enzyme stabilizing agents, reducing agents, china protecting agents, corrosion inhibitors, soil suspending ingredients, drainage promoting ingredients, dyes, perfumes, fillers, crystal modifiers and the like ingredients represent examples of functional classes of additional automatic dishwashing composition additives. Suitable inorganic builders include polyphosphates, for example, tripolyphosphate, pyrophosphate or metaphosphate, carbonates, bicarbonates and alkali silicates. Examples of water-soluble organic builder components include the alkali metal salts of polyacetates, carboxylates, polycarboxylates and polyhydroxy sulfonates. Particularly preferred are the sodium and potassium salts of the organic and inorganic builders. Additional examples include sodium citrate, sodium oxydisuccinate and sodium mellitate. Normally these builder ingredients can be used in an amount up to 60%, preferably in the range from 10 to 50% by weight.

Suitable examples of sequestering agents include alkali metal salts of ethylenediaminetetraacetic acid and nitrilotriacetic acid.

Examples of china protecting agents include silicates, water-soluble aluminosilicates and aluminates. Carboxymethylcellulose is a well-known soil suspending agent for use in the like compositions whereas fillers are mostly represented by sodium sulfate, sucrose, sucrose esters and the like.

Pasty, gel-like foam, or viscous liquid compositions can include many of the above-discussed additional ingredients, but usually at a lower level in view of the higher active concentration. In such compositions, materials which are favored as builders or to provide alkalinity include polyphosphates, carbonates, bicarbonates, silicates, alkanolamines, especially mono-, di- and triethanolamine, and the organic builders and sequestering agents discussed above.

In order to provide satisfactory pasty compositions, a small amount, e.g., up to 20%, of a solvent or solubilizing material or of a gel-forming agent can be included. Most commonly, water is used in this context and forms the continuous phase of a concentrated dispersion. Certain nonionic detergents at high levels form a gel in the presence of small amounts of water and other solvents. Such gelled compositions are also envisaged in the present invention.

In many cases, it is desirable to include a viscosity control agent or a thixotropic agent to provide a suitable product form. For example, aqueous solutions or dispersions of the binary active system of the invention can be thickened or made thixotropic by the use of conventional agents such as methyl cellulose, carboxymethylcellulose, starch, polyvinyl pyrrolidone, gelatin, colloidal silica, natural or synthetic clay minerals, and the like.

The following nonlimiting examples serve to facilitate the understanding of the invention and to illustrate the advantages derivable therefrom.

Granular automatic compositions were prepared in a conventional manner having the following formulae:

| Ingredients | Composition in % by weight A | Example I |
|---|---|---|
| Ethylene oxide/propylene oxide condensate of trimethylol propane[1] | 2.7 | 10 |
| Monostearyl acid phosphate[2] | 0.1 | 0.3 |
| Sodium cumene sulfonate | — | 10 |
| Anhydrous sodium tripolyphosphate | 46 | — |
| Sodium carbonate | — | 20 |
| Sodium bicarbonate | — | 10 |
| Silicate solids | | |
| Ratio: $SiO_2/Na_2O = 2.0$ | — | 20 |
| Ratio: $SiO_2/Na_2O = 2.9$ | 17 | — |
| $(NaPO_3)_{21}$ | — | 2 |
| Chlorinated trisodium orthophosphate | 22 | — |
| Proteolytic enzyme[3] | — | 0.5 |
| Balance to 100% | Water | Sodium Sulfate |

[1] & [2] "PLURADOT HA-433" Wyandotte
[3] SP-72 (ESPERASE) Novo Industries A/S, Copenhagen, Denmark 1.5 Anson units/gram of enzyme preparation. Isoelectric point ≃ 11.0

The above compositions were used for comparative cleaning, spotting and filming evaluations according to the procedure described hereinafter.

Spotting and Filming

An automatic dishwashing machine was filled with dishes. Four test glasses (Libbey Safe Edge 10 oz. tumblers #553) were added in predetermined (the same for all tests) positions in the upper rack. Prior to placement in the machine, two of the test glasses were soiled with a thin film of milk by coating them with refrigerated whole milk. Thirty-five grams of a 4:1 weight mixture of homogenized margarine and dry milk were placed in a 50 ml. beaker and inverted in the top rack of the dishwasher. The required amount of detergent product was then added to the dispenser cup. The test consisted of 4 washer cycles whereby the four glasses were graded at the end of the 4 cycles. The levels of spotting and filming performance were appraised with the aid of a 1–10 scale of photographic standards (separate standards for spotting and filming) wherein 1 represents completely unacceptable performance and 10 represents a level of performance where residual spotting and filming do not occur. The 8 grades (4 spotting; 4 filming) so obtained were averaged to determine average spotting and filming grades.

Cleaning

Two sets of dishes were identically soiled with foods (dried soils, baked soils, cooked soils) and were washed under identical conditions in automatic dishwashers whereby in one dishwasher the detergent composition of this invention and in the second dishwasher a commercially available chlorine-bleach containing detergent was used. The soiled dishes were loaded according to an established loading pattern, i.e. a dish soiled with a given soil was always placed in the same spot in the dishwasher. The soiled surfaces faced the water spray. The washed dishes were graded in a round robin design with the aid of a clean dish and a soiled dish to dimension the range of performance. A 0 to 4 scale was used to evaluate the performance differences, wherein 4 means that in the pair graded, one dish was a whole lot better than the second; 3 means that one dish was a lot better than the second; 2 means that one dish was better than the second; 1 means that one dish was thought to be better than the second; and 0 means that both dishes were equal. A performance grade was calculated for each soil.

The performance grade served for calculating a cleaning grade with the following formula:

$$\frac{\text{Performance Grade Test Dish} - \text{Performance Grade Soiled Dish}}{\text{Performance Grade Clean Dish} - \text{Performance Grade Soiled Dish}} \times 100 = \text{Cleaning Grade}$$

The above compositions were used for comparative automatic dishwashing runs to evaluate the spotting, filming and cleaning performance according to the testing procedure set forth hereinbefore. Additional test parameters were:

Water Hardness: 15 U.S. grains/gallon
Washing Temperature: 130° F
Product Concentration: 0.3%

The cleaning grade results were as follows:

| Food Residue | CLEANING GRADE Composition A | Ex. I |
|---|---|---|
| DRIED SOIL | 73.0 | 77.4 |
| (egg, rice, spinach) | 75.8 | 88.2 |
| COOKED SOIL | 57.4 | 64.0 |
| (beef stroganoff, tapioca) | 66.4 | 72.2 |

These results clearly show the cleaning performance superiority of the compositions of this invention versus what was obtained from a leading commercially available automatic dishwashing composition.

The spotting and filming performance were also determined and showed the compositions of this invention to be capable of providing an excellent performance thus contributing to the overall performance superiority of the compositions of this invention versus commercially available dishwashing compositions.

Substantially similar results can also be obtained when the sodium cumene sulfonate is replaced with an equivalent amount of sodium toluene sulfonate, sodium xylene sulfonate, sodium benzene sulfonate, sodium trimethylbenzene sulfonate, sodium ethylmethylbenzene sulfonate, sodium ethylbenzene sulfonate, or mixtures thereof.

Substantially similar results are also obtained when the nonionic surfactant of Example I is substituted with a substantially identical alkoxylate containing instead of the trimethylolpropane radical selected from the group consisting of propylene glycol, glycerine, pentaerythritol and ethylene diamine. Superior automatic dishwashing performance comparable to Example I is also obtained in replacing the trimethylolpropane alkoxylate by an equivalent amount of the condensation product of one mole of tallow alcohol and 9 moles of ethylene oxide; or with the condensation product of $C_{14-15}$ alcohol with 7 moles of ethylene oxide.

An excellent performance is also obtained when the monostearyl acid phosphate of Example I is replaced by a silicone suds suppressant selected from the group consisting of dimethyl, dipropyl-, dibutyl-, methylethyl-, and phenylmethyl-polysiloxane and mixtures thereof in an amount of 0.1, 0.2, 0.3, 0.35, 0.4 and 0.45% respectively.

Results substantially comparable to those of Example I can also be obtained when the suds suppressant is represented by a microcrystalline wax having a melting point from 65° to 100° C and which is selected from petrolatum and oxidized petrolatum waxes; Fischer-Tropsch and oxidized Fischer-Tropsch waxes; ozokerite, ceresin; montan wax, beeswax; candelilla and carnauba wax.

Results substantially similar to those of Example I can also be secured by replacing the enzyme preparation with an equivalent amount of AZ-PROTEASE.

Granular detergent compositions were prepared in a conventional manner having the following formulae:

| Ingredients | B | COMPOSITION % BY WEIGHT EXAMPLES II | III | IV | V | VI |
|---|---|---|---|---|---|---|
| Ethylene oxide/propylene oxide condensate of trimethylol propane[1] | 4.85 | 9.7 | 9.7 | — | 9.7 | 9.7 |
| Condensate of one mole of tallow alcohol with 9 moles of ethylene oxide | — | — | — | 3.5 | — | — |
| Sodium cumene sulfonate | — | 10 | 10 | 3.5 | 10 | 10 |
| Monostearyl acid phosphate[2] | 0.15 | 0.3 | 0.3 | 0.5 | 0.3 | 0.3 |
| Chlorinated trisodium phosphate | 22 | — | — | — | — | — |
| Sodium polymetaphosphate $(NaPO_3)_{21}$ | — | 2 | 2 | 2 | — | — |
| Sodium silicate solids - Ratio $SiO_2/Na_2O = 2.0$ | — | 20 | 20 | 20 | 20 | 20 |
| $SiO_2/Na_2O = 2.9$ | 17.5 | — | — | — | — | — |
| Sodium carbonate | — | 30 | 20 | 12 | — | — |
| Sodium bicarbonate | — | — | 10 | 18 | — | — |
| Sodium dichlorocyanurate | — | — | — | — | — | — |
| Sodium tripolyphosphate | 24 | — | — | — | 24.8 | — |
| Sodium nitrilotriacetate | — | — | — | — | — | 50 |
| SP-72 (ESPERASE) (R)[3] | — | — | 0.5 | — | — | — |
| ALCALASE(R)[4] | — | 4 | — | 1 | 1 | 1 |
| Sodium sulfate | 21 | 24 | 27.5 | 39.5 | 34.2 | 9 |
| Moisture, perfume, dyes, etc. | Balance to 100 | — | — | — | — | — |

[1] & [2] "PLURADOT HA-433" Wyandotte
[3] SP-72 (ESPERASE) Iso-electric point: 11.0 Novo Industries A/S, Copenhagen, Denmark 1.5 Anson units/gram enzyme preparation
[4] "ALCALASE" Iso-electric point: 9.1 Novo Industries A/S, Copenhagen, Denmark 3.0 Anson units/gram enzyme preparation The spotting and filming performance for the above automatic dishwashing compositions were determined according to the procedure set forth in Example I above.

The cleaning performance was visually graded as follows. White china plates were soiled with a mixture of protein/lipid soils and washed in a commercially available automatic dishwasher. The washed plates were visually graded by judges who are experts for that kind of grading versus totally clean (100% cleaning) and soiled (0% cleaning) plates. The cleaning grade represented the % soil removed averaged for 3 plates. Additional washing parameters were Product Concentration: 0.3%
Water Hardness: 15 U.S. grains/gallon
Washing Temperature: 130° F The cleaning, spotting and filming results were as follows:

| COMPOSITION | SPOTTING | FILMING | CLEANING (%) |
|---|---|---|---|
| EXAMPLE II | 8.2 | 8.0 | 100 |
| EXAMPLE III | 7.6 | 8.0 | 100 |
| EXAMPLE IV | — | — | 100 |
| EXAMPLE V | 7.8 | 7.7 | 100 |
| EXAMPLE VI | 9.0 | 8.8 | 90 |
| B | 7.9 | 8.1 | 0 |

The above results confirm the overall performance superiority resulting from the use of the compositions of the instant invention — Examples II, III, IV, V and VI — versus the results obtainable from the use of an automatic dishwashing composition which is commercially sold.

| INGREDIENTS | EXAMPLES IN % BY WEIGHT VII | VIII | IX | X | XI |
|---|---|---|---|---|---|
| Ethylene Oxide/propylene oxide condensate of trimethylol propane[1] | 4.85 | 9.7 | — | 2.5 | 10 |
| Condensation product of one mole tallow alcohol and 9 moles ethylene oxide (TAE9) | — | — | 5 | 2.5 | — |
| Sodium cumene sulonfate | 5 | 9 | 8 | 5 | — |
| Potassium toluene sulfonate | — | — | — | — | 10 |
| Monostearyl acid phosphate[2] | 0.15 | 0.3 | 0.8 | 0.08 | 0.3 |
| Sodium polymetaphosphate $(NaPO_3)_{21}$ | — | — | 2 | 2 | — |
| Sodium tripolyphosphate | 45 | — | — | — | 25 |
| Trisodium phosphate | 22 | — | — | — | — |
| Sodium carbonate | — | 10 | 20 | 20 | — |
| Sodium bicarbonate | — | — | 10 | 10 | — |
| Sodium hitrilotriacetate | — | 50 | — | — | — |
| Sodium silicate solids Ratio: $SiO_2/Na_2O = 2.0$ | 20 | 20 | 20 | 20 | 20 |
| SP-72 (ESPERASE) (R)[3] | 0.5 | 0.5 | 0.5 | 0.5 | 0.5 |
| Sodium sulfate | Balance to 100 | | | | |

[1] & [2] "PLURADOT HA-433" Wyandotte
[3] SP-72 (ESPERASE) Novo Industries A/S, Copenhagen, Denmark, Iso-electric point 11.0, 1.5 Anson units/gram enzyme preparation The spotting and filming performance for automatic dishwashing compositions VII - XI inclusive were determined according to the test method set forth in EXAMPLE I above whereby a commercially available automatic dishwashing composition — COMPOSITION A hereinbefore defined — was used as reference.

The spotting and filming results were as follows:

| COMPOSITION | SPOTTING | FILMING |
|---|---|---|
| A | 8.2 | 7.9 |
| EXAMPLE VII | 9.0 | 9.0 |
| EXAMPLE VIII | 9.0 | 8.8 |
| EXAMPLE IX | 9.0 | 9.0 |
| EXAMPLE X | 8.7 | 8.9 |
| EXAMPLE XI | 8.6 | 8.5 |

The above results highlight the outstanding spotting and filming performance obtained from the use of the compositions of this invention versus a commercially available composition. It is noteworthy that the high performance is not affected by substituting tripolyphosphate builders by carbonate/bicarbonate/sulfate mixtures.

Substantially identical results were also obtained when the sodium nitrilotriacetate in EXAMPLE VIII was substituted by the same quantity of a salt selected from the group consisting of sodium oxydisuccinate and sodium citrate.

Examples of pasty or gel-like compositions are as follows:

EXAMPLE VIII

| Ingredient | % in Composition By Weight |
|---|---|
| Pluradot HA-430 [1] | 30 |
| Sodium cumene sulfonate | 30 |
| SAG-100 [2] | 1 |
| Anhydrous sodium tripolyphosphate | 19 |
| Sodium silicate ($SiO_2/Na_2O$ = 2.0) | 17 |
| Alcalase(R) | 2 |
| Minors | 1 |

[1] Ethylene oxide/propylene oxide condensate of trimethylol propane.
[2] A polydimethylsiloxane suds suppressor, commercially available from Union Carbide.

EXAMPLE IX

| Ingredient | Wt. % in Composition |
|---|---|
| Pluradot HA-430 | 15 |
| Condensation product of 1 mole tallow alcohol and 9 moles ethylene oxide | 15 |
| Sodium toluene sulfonate | 20 |
| Triethanolamine | 20 |
| Oleic acid | 4 |
| Monostearyl acid phosphate | 0.4 |
| SAG-100 | 0.6 |
| Alcalase(R) | 2 |
| Sodium carbonate | 23 |

EXAMPLE X

| Ingredient | Wt. % in Composition |
|---|---|
| Pluradot HA-433 | 39 |
| Sodium cumene sulfonate | 38.5 |
| Colloidal silica | 4 |
| Oleic acid | 4 |
| Monostearyl acid phosphate | 0.4 |
| SAG-100 | 1 |
| Monoethanolamine | 9 |
| Alcalase(R) | 2.5 |
| Minors | 1.6 |

EXAMPLE XI

| Ingredient | Wt. % in Composition |
|---|---|
| Condensation product of 1 mole tallow alcohol with 9 moles ethylene alcohol | 10 |
| Sodium cumene sulfonate | 9 |
| Sodium silicate solids - Ratio $SiO_2/Na_2O$ = 2.4 | 30 |
| Sodium carbonate | 5 |
| Sodium tripolyphosphate | 25 |
| SAG-100 | 0.5 |
| SP-72 (Esperase)(R) | 1.2 |
| Triethanolamine | 19 |
| Minors (dye, perfume, etc.) | 0.3 |

EXAMPLE XII

| Ingredient | Wt. % in Composition |
|---|---|
| Condensation product of 6 moles ethylene oxide with 1 mole of tallow alcohol | 30 |
| Sodium cumene sulfonate | 20 |
| Monoethanolamine | 10 |
| Sodium silicate ($SiO_2/Na_2O$ = 2.0) | 18 |
| Polyvinyl pyrrolidone (m.w. = 360,000) | 5 |
| Alcalase(R) | 2 |
| Microcrystalline wax | 1 |
| Minors | 1 |
| Water | 13 |

The above compositions provide during conventional automatic dishwashing superior overall performance, especially reduced spotting and filming comparable to what is obtained with leading commercial active chlorine containing detergent compositions.

EXAMPLE XIII

Granular automatic dishwasher detergent compositions, having the following formulae, were prepared in a conventional manner:

| Ingredients | Composition in % by weight | | | | | | |
|---|---|---|---|---|---|---|---|
| | A | B | C | D | E | F | G |
| Ethylene oxide/propylene oxide condensate of trimethylol propane [1] | 2.7 | 2.7 | 10 | 9.7 | — | — | 2.7 |
| Condensation product of one mole tallow alcohol with 9 moles of ethylene oxide ($TAE_9$) | — | — | — | — | 3.5 | 3.5 | — |
| Monosteryl acid phosphate [2] | 0.1 | 0.1 | 0.3 | 0.3 | — | — | 0.1 |
| Sodium cumene sulfonate | — | — | 10 | 10 | 2.5 | 2.5 | — |
| Anhydrous sodium tripolyphosphate | 46 | 46 | — | — | — | — | 46 |
| Sodium carbonate | — | — | 30 | 30 | 14 | 15 | — |
| Sodium bicarbonate | — | — | — | — | 16 | 15 | — |
| Silicate solids | | | | | | | |
| Ratio $SiO_2/Na_20$= 2.0 | — | — | 20 | 20 | — | — | |
| Ratio = 2.58 | | | | | — | — | |
| Ratio = 2.9 | 17 | 17 | | | — | — | 17 |
| Chlorinated trisodium orthophosphate | 22 | — | — | — | — | — | — |
| Trisodium orthophosphate | — | 22 | — | — | — | — | 22 |
| Sodium Polymetaphosphate $(NaPO_3)_{21}$ | — | — | 2 | 2 | 2 | 2 | — |
| SP-72 [3] | — | — | — | — | — | 0.5 | 0.6 |
| Alcalase [4] | — | — | — | 4 | 1 | — | — |
| Balance to 100% | $H_2O$ | $H_2O$ | Sodium Sulfate | Sodium Sulfate | Sodium Sulfate | Sodium Sulfate | $H_2O$ |

[1] and [2] available as "PLURADOT HA-433" from Wyandotte.
[3] proteolytic enzyme available from Novo Industries A/S, Copenhagen Denmark. 1.1 Anson units/gram of enzyme preparation (8.0 Kilo Novo Protease Units).
[4] a proteolytic enzyme 4.0 Anson units/gram of enzyme preparation available from Novo Industries A/S, Copenhagen, Denmark, which exhibits a proteolytic activity of less than 80% of maximum activity when tested at pH 12 using the Anson hemoglobin method carried out in the presence of urea.

The above compositions were used for comparative spotting and filming evaluations according to the procedure described hereinafter.

Spotting and Filming

An automatic dishwashing machine was filled with dishes. Four test glasses (Libbey Safe Edge 10 oz. tumblers #553) were added in predetermined (the same for all tests) positions in the upper rack. Prior to placement in the machine, two of the test glasses were soiled with a thin film of milk by coating them with refrigerated whole milk. Thirty-five grams of a 4:1 weight mixture of homogenized margarine and dry milk were placed in a 50 ml. beaker and inverted in the top rack of the dishwasher. The required amount of detergent product was then added to the dispenser cup. The test consisted of 4 washer cycles whereby the four glasses were graded at the end of the 4 cycles. The levels of spotting and filming performance were appraised with the aid of a 1–10 scale of photographic standards (separate standards for spotting and filming) wherein 1 represents completely unacceptable performance and 10 represents a level of performance where residual spotting and filming do not occur. The 8 grades (4 spotting; 4 filming) so obtained were averaged to determine average spotting and filming grades. Composition A, a typical bleach-containing automatic dishwasher detergent composition, was taken as the standard for purposes of reporting results and the results are reported as differences from this standard.

The tests were carried out using a product concentration of 0.3%, at a washing temperature of 130° F, with water of a hardness of 15 U.S. grains/gallon.

The results of these tests are reported in the table below.

| Composition | ΔSpotting | ΔFilming |
|---|---|---|
| A | 0.0 | 0.0 |
| B | −1.3 | −0.7 |
| C | +0.4 | +0.1 |
| D | +0.6 | +0.9 |
| E | −0.8 | −0.8 |
| F | +0.1 | +0.7 |
| G | +0.5 | +0.2 |

The data demonstrates that spotting and filming performance suffered, generally, when the bleaching component was taken out of an automatic dishwasher detergent composition (composition B). Although this problem was alleviated in compositions C and D, it is necessary to include high levels of nonionic surfactant and compatibilizing agent to achieve the result. The use of low levels of nonionic surfactant and compatibilizing agent, together with an enzyme which does not fall within the preferred proteolytic enzymes of this invention (composition E), yielded relatively low spotting and filming results. However, when the preferred proteolytic enzymes of the instant invention were included in the composition, improved spotting and filming results were achieved with a compound containing low levels of nonionic surfactant and compatibilizing agent (compound F) and a low level of nonionic surfactant alone (compound G).

Substantially similar results can also be obtained when the sodium cumene sulfonate of composition F is replaced with an equivalent amount of sodium toluene sulfonate, sodium xylene sulfonate, sodium benzene sulfonate, sodium trimethylbenzene sulfonate, sodium ethylmethylbenzene sulfonate, sodium ethylbenzene sulfonate, or mixtures thereof.

Substantially similar results are also obtained when the nonionic surfactants of Compositions F and G are substituted with a substantially identical alkoxylate containing instead of the trimethylolpropane radical an alkylol selected from the group consisting of propylene glycol, glycerine, pentaerythritol and ethylene diamine; or where the surfactant is the condensation product of tallow alcohol with from 9 to 20 moles of ethylene oxide, or the condensation product of $C_{14-15}$ alcohol with 5 to 17 moles of ethylene oxide.

An excellent performance is also obtained when the monostearyl acid phosphate of Composition G is replaced by a silicone suds suppressant selected from the group consisting of dimethyl-, diethyl-, dipropyl-, dibutyl-, methylethyl-, and phenylmethyl-polysiloxane and mixtures thereof in an amount of 0.1, 0.2, 0.3, 0.35, 0.4 and 0.45% respectively.

Results substantially comparable to those of Compositions F and G can also be obtained when the suds suppressant is represented by a microcrystalline wax having a melting point from 65° to 100° C and which is selected from petrolatum and oxidized petrolatum waxes; Fischer-Tropsch and oxidized Fischer-Tropsch waxes; ozokerite, ceresin; montan wax, beeswax; condelilla and carnauba wax.

Results substantially similar to those of Compositions F and G can also be secured by replacing the enzyme preparation with an equivalent amount of SP-88 or a mixture of SP-72 and SP-88; or where the proteolytic enzyme is replaced by one cultivated from the bacterium strain NCIB 10317, NCIB 10147, NCIB 10313, NCIB 10315, or NRRL B 1107.

It is noteworthy that the high performance of the compositions of the present invention is not affected by substituting the tripolyphosphate builder with a carbonate/bicarbonate/sulfate mixture.

Substantially comparable results are also obtained where the builders of Composition F and G are replaced by sodium or potassium tripolyphosphate, pyrophosphate, metaphosphate, bicarbonate or carbonate; an alkali metal salt of a polyacetate, carboxylate, polycarboxylate or a polyhydroxy sulfonate; or sodium citrate sodium oxydisuccinate or sodium mellitate.

EXAMPLE XIV

A biodegradable, hydrous paste automatic dishwasher detergent composition, having the following formula was prepared in a conventional manner.

| Ingredient | % by weight |
|---|---|
| Condensation product of $C_{14-15}$ alcohol with 7 moles ethylene oxide (Neodol 45-7) | 5.8 |
| Hydrous dry $SiO_2$:$Na_2O$ (2.6r) | 24.0 |
| Triethanolamine | 27.9 |
| Sodium tripolyphosphate 6 $H_2O$ | 35.0 |
| SP-88 (1) | 1.5 |
| DB-544 suds suppressor (2) | 0.8 |
| Minors and moisture | Balance to 100 |

(1) proteolytic enzyme available from Novo Industrials A/S, Copenhagen, Denmark, which exhibits a proteolytic activity greater than 80% of maximum activity when tested at pH 12 using the Anson hemoglobin method, carried out in the presence of urea (2) a siloxane/glycol copolymer suds suppressor, available from Dow Corning This composition was run in a spotting/filming test, carried out using the procedure described in Example XIII, and received a Δspotting grade of +0.3 and a Δfilming grade of +0.2.

EXAMPLE XV

A gel-like automatic dishwasher detergent composition, having the following formula, was prepared in a conventional manner.

| Ingredient | % by weight |
|---|---|
| $TAE_9$ | 7.9 |
| Wet $SiO_2$:$Na_2O$ (2.58r) | 30.0 |
| Triethanolamine | 7.9 |
| Sodium tripolyphosphate | 19.8 |
| SP-88 | 1.2 |
| Minors and moisture | Balance to 100 |

This composition was run in a spotting/filming test, carried out in accordance with the procedure described in Example XIII, and received a Δspotting grade of +0.3 and a Δfilming grade of +0.1.

EXAMPLE XVI

A granular automatic dishwasher detergent composition, having the following formula, is prepared in a conventional manner.

| Ingredient | % by weight |
|---|---|
| $TAE_9$ | 2.57 |
| DB544 suds suppressor | 0.2 |
| Sodium tripolyphosphate | 46.0 |
| $SiO_2$:$Na_2O$ (2.8r) | 17.0 |
| Trisodium polyphosphate | 22.0 |
| SP-88 | 0.6 |
| Minors and moisture | Balance to 100 |

The above composition provides, during conventional automatic dishwashing, superior performance, especially in terms of reduced spotting and filming, comparable to what is obtained with leading commercial bleach-containing detergent compositions.

EXAMPLE XVII

An anhydrous paste automatic dishwasher detergent composition, having the following formula, is prepared in a conventional manner.

| Ingredient | % by weight |
|---|---|
| Pluradot HA-433 | 10.0 |
| Anhydrous $SiO_2$ (2.0r) | 25.0 |
| Triethanolamine | 30.0 |
| Anhydrous sodium tripolyphosphate | 27.6 |
| SP-72 | 1.2 |
| Sodium carbonate | 5.2 |
| Minors | Balance to 100 |

The above composition provides, during conventional automatic dishwashing, superior performance, especially in terms of reduced spotting and filming, comparable to what is obtained with leading commercial bleach-containing detergent compositions.

EXAMPLE XVIII

A hydrous paste automatic dishwasher detergent composition, having the following formula, is formulated in a conventional manner.

| Ingredient | % by weight |
|---|---|
| Pluradot HA-433 | 6.9 |
| Hydrous dry $SiO_2$:$Na_2O$ (2.6r) | 24.0 |
| Triethanolamine | 27.3 |
| Sodium tripolyphosphate | |

-continued

| Ingredient | % by weight |
|---|---|
| 6 $H_2O$ | 36.4 |
| SP-88 | 1.0 |
| Minors and moisture | Balance to 100 |

The above composition provides, during conventional automatic dishwashing, superior performance, especially in terms of reduced spotting and filming, comparable to what is obtained with leading commercial bleach-containing detergent compositions.

What is claimed is:

1. A cleaning composition, particularly suitable for use in automatic dishwashers and having improved anti-redeposition properties, consisting essentially of:

(a) from about 0.5 to about 20% by weight of an alkoxylated nonionic surface-active agent selected from the group consisting of:

(i) the condensation product of one mole of a carboxylic acid having from about 10 to about 18 carbon atoms with from about 5 to about 50 moles of ethylene oxide;

(ii) the condensation point of an alcohol having from about 10 to about 24 carbon atoms with from about 5 to about 50 moles of ethylene oxide;

(iii) polyethylene glycol having a molecular weight of from about 1400 to about 30,000;

(iv) the condensation product of one mole of alkyl phenol wherein the alkyl chain contains from about 8 to about 18 carbon atoms with from about 4 to about 50 moles of ethylene oxide;

(v) the condensation product of benzyl chloride and an ethoxylated alkyl phenol wherein the alkyl group has from about 6 to about 12 carbon atoms and wherein from about 12 to about 20 moles of ethylene oxide have been condensed per mole of alkyl phenol;

(vi) polyetheresters of the formula $$(ClC_6H_4)_2CHCO_2(CH_2.CH_2.O)_xR$$

wherein $x$ is from 4 to 20 and R is an alkyl group with from 1 to 4 carbon atoms;

(vii) polyoxyalkylene compounds of the formula $$Y[(C_3H_6O)_n(C_2H_4O)_mH]_x$$

wherein Y is an organic radical having from 1 to about 18 carbon atoms and containing $x$ reactive hydrogen atoms and the values of $n$ and $m$ are such that the $(C_2H_4O)$ content is from about 10 to about 90% by weight;

(viii) the alkoxylated nonionic surface-active agents having the formula of (i) through (vii) in which the terminal hydroxyl of the alkoxy group is acylated with a monobasic acid; and (ix) mixtures thereof;

(b) from about 0.001 to about 5% by weight of a proteolytic enzyme which exhibits a proteolytic activity of 80 to 100% of maximum activity when measured at pH 12 by the Anson hemoglobin method carried out in the presence of urea, said enzyme being present in an amount such that the detergent composition has a proteolytic activity of at least 6.0 Anson units/kg.;

(c) from 0 to about 60% by weight of detergent builder ingredients selected from the group consisting of the alkali metal salts of polyphosphates, carbonates bicarbonates, silicates, polyacetates, carboxylates, polycarboxylates, polyhydroxy sulfonates and mixtures thereof;

(d) from 0 to about 20% water;

(e) from 0 to about 75% of china protecting agents selected from the group consisting of silicates, water-soluble aluminosilicates, aluminates and mixtures thereof;

(f) from 0 to about 75% of fillers selected from the group consisting of sodium sulfate, sucrose, sucrose esters and mixtures thereof;

(g) from 0 to about 20% by weight of a sulfonated aromatic compatibilizing agent having a critical micelle concentration greater than 1% by weight at 25° C, wherein the weight ratio of said alkoxylated nonionic surface-active agent to said sulfonated compatibilizing agent is in the range from about 2:5 to about 5:3;

which is substantially free of bleach and brightener components.

2. A composition according to claim 1 wherein said alkoxylated nonionic surface-active agent is selected from the group consisting of a condensation product of one mole tallow alcohol with from about 6 to about 20 moles of ethylene oxide; and an alkoxylate having the formula $$Y[(C_3H_6O)_n(C_2H_4O)_mH]_x$$

wherein $x$ has a value of at least about 2, $n$ has a value such that the molecular weight of the polyoxypropylene hydrophobic base is at least 900 and $m$ has a value such that the oxyethylene content of the molecule is from about 10 to 90% by weight, and wherein Y is selected from the group consisting of propylene glycol, glycerine, pentaerythritol, trimethylolpropane, ethylenediamine and mixtures thereof.

3. A composition in accordance with claim 1 wherein said compatibilizing agent is selected from the group consisting of an alkali metal salt of benzene sulfonate, toluene sulfonate, xylene sulfonate, cumene sulfonate, trimethyl benzene sulfonate, ethyl benzene sulfonate, ethylmethyl benzene sulfonate and mixtures thereof.

4. A composition according to claim 1 wherein said proteolytic enzyme is one cultivated from a bacterium strain selected from the group consisting of NCIB 10317, NCIB 10147, NCIB 10313, NCIB 10315, NRRL B 1107, and mixtures thereof.

5. A composition according to claim 4 wherein said proteolytic enzyme is one cultivated from a bacterium strain selected from the group consisting of NCIB 10147, NRRL B 1107, and mixtures thereof.

6. A composition according to claim 1 which; in addition, contains from 0.001 to about 5% of a suds regulating agent selected from the group consisting of:

(a) a siloxane having the formula

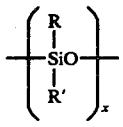

wherein $x$ is from about 20 to about 2,000 and R and R' are each alkyl or aryl groups;

(b) a microcrystalline wax having a melting point in the range from about 35° to about 115° C and a saponification value of less than 100;

(c) an alkyl phosphate ester component selected from the group consisting of stearyl acid phosphate and oleyl acid phosphate;

(d) a self-emulsifying silicone suds suppressor; and (e) mixtures thereof.

7. A composition according to claim 6 wherein said microcrystalline wax suds-regulating agent has a melting point from about 65° to about 100° C and is selected from the group consisting of microcrystalline and oxidized microcrystalline petrolatum waxes, Fischer-Tropsch and oxidized Fischer-Tropsch waxes, ozokerite, ceresin, montan wax, beeswax, candelilla, carnauba and mixtures thereof.

8. A composition according to claim 6 wherein said proteolytic enzyme is one cultivated from a bacterium strain selected from the group consisting of NCIB 10317, NCIB 10147, NCIB 10313, NCIB 10315, NRRL B 1107, and mixtures thereof.

9. A composition according to claim 8 wherein said proteolytic enzyme is one cultivated from a bacterium strain selected from the group consisting of NCIB 10147, NRRL B 1107, and mixtures thereof.

* * * * *

UNITED STATES PATENT AND TRADEMARK OFFICE

CERTIFICATE OF CORRECTION

PATENT NO. : 4,101,457

DATED : July 18, 1978

INVENTOR(S) : Geoffrey Place & Edward John Maguire, Jr.

It is certified that error appears in the above-identified patent and that said Letters Patent are hereby corrected as shown below:

Column 5, line 67, "referred" should be -- preferred --.

Column 8, line 13, "formulaa" should be -- formula --.

Column 8, line 48, "$(CLC_6H_4)$" should be -- $(ClC_6H_4)$ --.

Column 9, line 37, "$Y[(CL_3H_6O)$" should be -- $Y[(C_3H_6O)$ --.

Column 13, line 38, "The" should be -- the --.

Column 18, line 63 "dimethyl, dipropyl" should be -- dimethyl, diethyl-, dipropyl --.

Column 20, line 34, "hitrilotriacetate" should be -- nitrilotriacetate --.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,101,457

DATED : July 18, 1978

INVENTOR(S) : Geoffrey Place & Edward John Maguire, Jr.

It is certified that error appears in the above-identified patent and that said Letters Patent are hereby corrected as shown below:

Title Page, INID Code [63], last line, "Jun. 17, 1975," should be -- Jun. 17, 1974, --.

Column 1, line 14, "June 17, 1975," should be -- June 17, 1974, --.

Signed and Sealed this

*Twenty-third* Day of *November 1982*

[SEAL]

*Attest:*

GERALD J. MOSSINGHOFF

*Attesting Officer*

*Commissioner of Patents and Trademarks*